US005079541A

United States Patent [19]

Moody

[11] Patent Number: 5,079,541

[45] Date of Patent: Jan. 7, 1992

[54] SYSTEM AND METHOD FOR DETECTING MOVEMENT OF AN INFANT FROM A SECURE AREA

[76] Inventor: Thomas O. Moody, 1616 Centaur Circle, Lafayette, Colo. 80026

[21] Appl. No.: 532,738

[22] Filed: Jun. 4, 1990

[51] Int. Cl.[5] ..... G08B 23/00

[52] U.S. Cl. ..... 340/573; 340/572

[58] Field of Search ..... 340/572-573; 342/27-28; 455/100; 604/361

[56] References Cited

U.S. PATENT DOCUMENTS

| | | | |
|---|---|---|---|
| 4,598,272 | 7/1986 | Cox | 340/573 X |
| 4,694,284 | 9/1987 | Leveille et al. | 340/573 X |
| 4,854,328 | 8/1989 | Pollack | 340/573 X |
| 4,865,044 | 9/1989 | Wallace et al. | 340/573 X |
| 4,899,134 | 2/1990 | Wheeless, Jr. | 340/573 |

*Primary Examiner*—Glen R. Swann, III
*Assistant Examiner*—Thomas J. Mullen, Jr.
*Attorney, Agent, or Firm*—Rogers & Killeen

[57] ABSTRACT

An electronically and visually detectable diaper or article of apparel is used in a system and method for detecting the unauthorized movement of an infant from a secure area in a hospital. The diaper may have electronically detectable indicator tags embedded therein that are detectable by a transmitting and receiving unit positioned adjacent openings to the secure area. The diaper may also include a visually conspicuous appearance to defeat attempts to thwart the electronic detection system. The indicator tags may be positioned in perpendicular planes so that the transmitting and receiving unit may detect the diaper, regardless of the diaper's orientation as it passes through the transmitting and receiving unit.

19 Claims, 1 Drawing Sheet

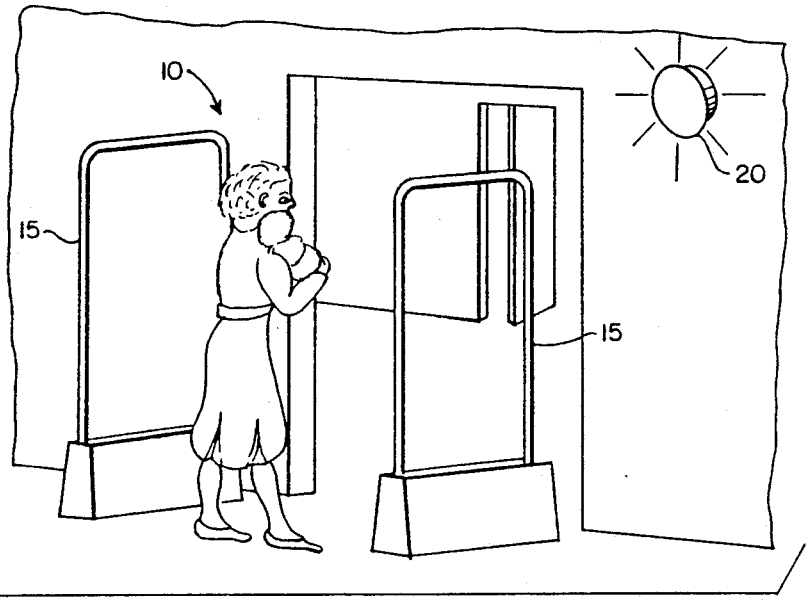
FIG. 1
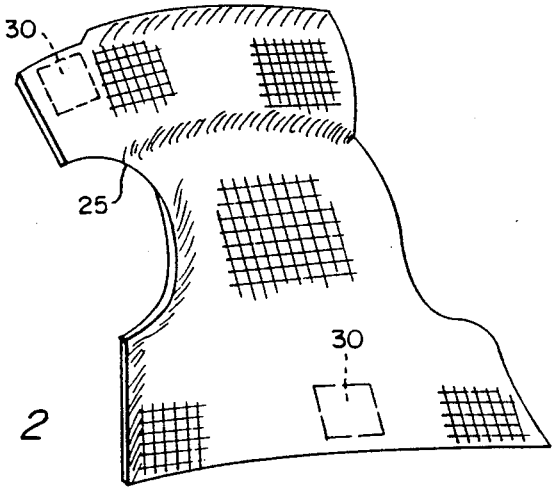
FIG. 2
FIG. 3
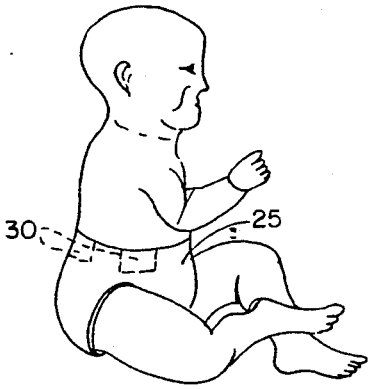
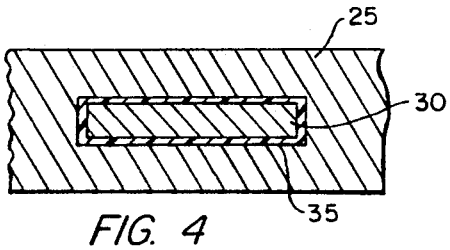
FIG. 4
FIG. 5
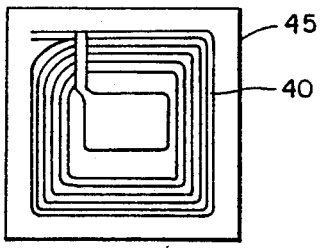

SYSTEM AND METHOD FOR DETECTING MOVEMENT OF AN INFANT FROM A SECURE AREA

BACKGROUND OF THE INVENTION the present invention relates to a system and method for detecting the movement of an infant from a secure area. More particularly, the present invention relates to a system and method for detecting the unauthorized movement, such as an abduction, of an infant wearing an electronically and/or visually detectable diaper or article of apparel from a secure area, such as a neonatal care unit in a hospital.

Hospital security is a significant concern to those responsible for the operation of infant care units, especially in view of the increasing frequency of abduction of infants from such units. The present invention applies electronic detection system technology to the problem of prevention of unauthorized removal of infants from a secure area in a hospital.

Electronic detection system technology has diverse applications. For example, retail merchants may affix electronically detectable indicator tags to their merchandise and install tag detection modules at their doors in an effort to deter theft. The indicator tags may be concealed so that a would-be thief would not be able to defeat this system by removing the tags from the merchandise. When the indicator tags are not so concealed, the tags are typically affixed to the merchandise so that they can be removed only by store personnel to thwart efforts to defeat the electronic detection system by removing the tags. The U.S. Pat. No. 4,471,343 to Lemelson is an example of such an electronic detection system.

Electronic detection system technology, as it has been applied to the detection of humans, has usually included an indicator tag attached to a person to be detected. In the event an indicator tag is to be worn by a reluctant participant, such as a prisoner at home, the indicator may be affixed to the body of the participant so that it cannot be readily removed by the participant or others. Such devices, however, are usually bulky and not suitable for wear by an infant. Further, such a device may actually harm the infant by chafing the infant's skin. See, for example, the heavy collars disclosed in U.S. Pat. No. 4,694,284 to Leveille, et al. and U.S. Pat. No. 4,777,477 to Watson.

In the event the participant is willing to wear an indicator tag, the tag may be designed to be easily removed because it is assumed that the participant does not want to defeat the system. The tag may be included in a bracelet, a shoe insert or an object carried by the participant. Such systems may be easily defeated by a participant who forgets or becomes unwilling to wear or carry the sensor. See, for example, the removable tags in U.S. Pat. No. 4,682,155 to Shirley, U.S. Pat. No. 4,684,933 to Dill, U.S. Pat. No. 4,555,696 to Brown, U.S. Pat. No. 4,095,214 to Minasy and U.S. Pat. No. 4,598,275 to Ross, et al.

The disadvantage of such systems for infant monitoring lies in the ease with which indicator tags can be identified and removed. An infant may be able to wear such devices but is unable to protest when the devices are removed to avoid detection when the infant is removed from the secure system.

Accordingly, it is an object of the present invention to provide a novel system and method for detecting the unauthorized passage of an infant from a secure area that obviates the problems of the prior art and is safe and easy to use.

It is a further object of the present invention to provide an electronically and visually detectable diaper in a system and method for detecting the passage of an infant from a secure area.

It is another object of the present invention to provide a system for detecting the passage of an infant from a secure area including a diaper or article of apparel having an indicator therein that is not sensed by an infant wearing the diaper or article of apparel.

It is yet a further object of the present invention to provide a system for detecting the passage of an infant from a secure area including diapers that have a visually conspicuous appearance so that attempts to defeat the system may be prevented.

It is still a further object of the present invention to provide an infant passage detection system wherein detection devices carried on the infant may be hidden in customary infant wear to resist detection and removal by unauthorized personnel.

These and many other objects and advantages will be readily apparent to one skilled in the art to which the invention pertains from a perusal of the claims and the following description of preferred embodiments when read in conjunction with the appended drawings.

DESCRIPTION OF THE DRAWINGS

FIG. 1 is a pictorial depiction of the operation of the detection system of the present invention.

FIG. 2 is a pictorial depiction of an embodiment of a diaper of the present invention.

FIG. 3 is a pictorial depiction of a diaper of the present invention being worn by an infant.

FIG. 4 is a cross-sectional view of the diaper of the present invention illustrating the sensor embedded therein.

FIG. 5 is a pictorial depiction of an embodiment of a sensor that may be embedded in the diaper of the present invention.

DESCRIPTION OF PREFERRED EMBODIMENTS

With reference now to the figures where similar elements have been given like numerical designation to facilitate an understanding of the present invention, and with particular reference to FIGS. 1-2, the present invention may include a transmitting and receiving unit 10 having spaced apart detection modules 15 positioned adjacent passageways to and from the secure area for detecting passage of an infant therebetween, an alarm 20 for indicating unauthorized passage through the spaced-apart modules 15 and an electronically and visually detectable diaper 25 adapted to be worn by an infant in the secure area and having one or more indicators 30 embedded therein.

While the security system described herein is described with reference to the diaper being detected, the detectable component could be any article of apparel normally worn by an infant, including booties, hats, and t-shirts. The security system may be more difficult to defeat if the detectable component is changed frequently.

The system of the present invention is preferably operated with the electronically and visually detectable diaper 25 used inside the secure area. When an infant wearing the diaper 25 is carried between modules 15, the modules detect the electronically detectable diaper and cause an alarm to sound. If a would-be abductor removes the electronically and visually detectable diaper 25 from the infant or replaces the diaper 25 with another diaper in an effort to thwart the system, personnel in the secure area would recognize such an attempt by the lack of the visually detectable diaper 25 on the infant.

The diaper 25 may be of any known material, including cloth and disposable material, that may be adaptable for use in a secure area, such as a neonatal care unit of a hospital. In a preferred embodiment, the diaper 25 may include a visually conspicuous appearance. To this end, the diaper may include a particular design, such as a checkerboard pattern or stripes, or it may have a color that would distinguish it from the traditional white diapers or from other diapers that may be used in the hospital apart from the secure area. Various patterns and/or colors may be used so that different sets of diapers may be used on different days of the week to further thwart efforts to defeat the system described herein. Preferably, the visually detectable diapers should be securely controlled, i.e., not available to the general public and not used in areas outside the area being secured.

The indicators 30, as will be described below, are used with the transmitting and receiving unit 10 to enable detection of the diaper as it passes between the modules 15. While one indicator 30 may be used in the diaper 25, the use of two indicators 30 increases the reliability of the detection system of the present invention. The use of two indicators 30 safeguards against the failure of one of the indicators and allows the indicators to be positioned in the diaper 25 so that at least one indicator is assured of being in position between the modules 15 to achieve sufficient surface area exposure to the modules to set off the alarm 20, regardless of the orientation of the diaper 25 relative to the modules. To this end, one indicator 30 may be positioned in the diaper in the waistband near the middle thereof and the second indicator 30 may be positioned near its side edge. As may be more clearly seen in FIG. 3, when the diaper 25 is being worn by an infant the two indicators 30 positioned at the middle and side edge of the waistband of the diaper are in nearly perpendicular planes to provide the appropriate surface area exposure. Plural indicators will also make more difficult furtive disabling of the security by discovery and unauthorized removal of the indicators.

The indicators 30 are preferably embedded in the diaper as illustrated in FIG. 4. The padding material of the diaper may be positioned on either side of the indicator 30 so that an infant wearing the diaper does not sense the presence of the indicator. The indicator may be encased in a water resistant material 35 to prevent disruption of the operation of the indicator when the diaper becomes damp due to normal use or washing. The indicators 30 may be embedded in the diaper 25 so as not to be visible.

Alternatively, the indicators may be placed in built-in, but hidden, pockets or folds in the diaper. Thus, the diapers can be manufactured without the indicators and the indicators 20 may be inserted into the built-in pockets at the secured area. Upon soiling of the diaper, the indicators 30 may be removed and reinstalled in another diaper.

The indicators 30 and the transmitting and receiving unit 10 may be a system known in the art that is able to provide a signal to set off an alarm upon passage of an infant wearing the diaper of the present invention through a passageway to or from the secure area. In a preferred embodiment the indicators 30 are resonance circuits that amplify a radio frequency signal in response to a signal received from one of the modules 15. When an infant wearing a diaper with embedded resonance circuits is positioned adjacent modules 15, the resonance circuits amplify a radio frequency signal in response to receipt of a signal generated by the transmitting portion of unit 10. The amplified signal from the resonance circuits is received in the receiver portion of unit which, in turn, generates an electronic signal that causes an alarm to sound. In other embodiments radio frequency transmitters, transponders, reprogrammable memory modules and the like may be used as the indicators with appropriate receiving equipment in the modules 15 to detect their operation and/or presence.

The transmitter portion of unit 10 may transmit a radio frequency signal over a wide frequency band for a short range. The receiver portion of unit 10 monitors these frequencies for electrical indications of an indicator being present. When the receiver portion of unit 10 detects that an indicator has moved into a position to receive and amplify a portion of the transmitted signal, alarm circuitry is activated.

For example, the transmitting and receiving unit 10 may transmit in the 7.4 to 9 MHz frequency band. The resonance circuit may be a tuned LC circuit with resonant frequency of approximately 8.2 MHZ. When an indicator with such a resonant frequency enters the field swept by the transmitter a drop in impedance is sensed in the receiver as a voltage pulse in a DC component of the demodulated signal.

The resonant circuit may be an inductor with eight to twelve turns of wire 40 on a flat substrate 45 two to three inches square such as illustrated in FIG. 5. Such an indicator may be detectable by the receiver of the transmitting and receiving unit for up to about four feet.

The indicators and the transmitting and receiving units of type suitable for the present invention have been marketed by the Sensormatic Electronics Corporation of Boca Raton, Florida under the mark "SAVER SYSTEM".

The substrate of the resonance circuit of the present invention may be flexible to conform to the shape of the diaper so that an infant wearing the diaper doesn't sense the presence of the resonance circuits. To this end, the resonance circuits may employ an inductor made of aluminum or copper materials screened onto a insoluble substrate such as a thin wafer of soft plastic, acrylic or the like. The resonance circuit may be paper thin and may be glued to the inside of the diaper.

In addition to sounding an alarm, the system may be coupled to the doors or elevators of the secure area to prevent egress by would-be abductors or to other security measures such as television recorders.

In operation, the present system may utilize visually detectable diapers, only some of which have indicators 30. Diapers not having indicators 30 imbedded therein, or having dummy indicators, could be tightly controlled and placed on the infant immediately prior to the removal of the infant from the secure area. Such diapers would pass through the detection unit without setting off the alarm and would tend to keep secret the fact that the indicators were hidden in others of the diapers.

Alternatively, the visually detectable diapers may be used inside the secure area and electronically detectable diapers used outside the secure area. Attempts to introduce the electronically detectable diapers into the secure area cause the alarm to sound.

In an alternative embodiment, the system of the present invention may be operated with an electronically detectable diaper (with the indicator 30 embedded therein, but of normal appearance) used inside the secure area and a visually detectable diaper (without the indicator, but with a visually conspicuous appearance) used outside the secure area. Detection of the electronically detectable diaper is as described above, except introduction of a visually detectable diaper into the secure area in an effort to thwart the detection system of the present invention could be detected by personnel in the secure area.

Also, a system of the present invention could be used to prevent the inadvertent exposure of some infants (wearing a detectable diaper) to a disease that might be isolated in a secure unit within a neonatal unit (where non-detectable diapers are used).

While the preferred embodiments of the present invention have been described, it is to be understood that the embodiments described are illustrative only and that the scope of the invention is to be defined solely by the appended claim when accorded a full range of equivalence, many variations and modifications naturally occurring to those skilled in the art from a perusal hereof.

I claim:

1. A system for detecting the passage of an infant from a secure area comprising:

(a) a first diaper adapted to be worn by an infant in the secure area, said first diaper comprising, (1) means for presenting a conspicuous appearance so that said first diaper is adapted to be visually distinguished from diapers not having said present means, and (2) indicator means embedded in said first diaper so that the presence of said indicator means is not sensed by an infant wearing said first diaper for causing a signal to be generated indicating passage of said first diaper from the secure area;

(b) detector means positioned adjacent openings to the secure area for detecting passage of said first diaper out of the secure area and for generating an electronic signal responsively thereto; and (c) alarm means for providing an alarm signal responsively to receipt of said electronic signal, so that an infant wearing said first diaper leaving the secure area is detected electronically by said detector means and an infant not wearing said first diaper attempting to evade said detector means can be detected visually by lack of said presenting means.

2. The system as defined in claim 1 wherein said indicator means comprises two resonance circuits positioned in said first diaper so that when said first diaper is being worn, said two resonance circuits are in nearly perpendicular planes to thereby improve the ability of said detector means to detect said indicator means.

3. The system as defined in claim 2 wherein each of said two resonance circuits further comprises water resisting means for preventing disruption of the operation of said circuits caused by the presence of fluid in said first diaper.

4. The system as defined in claim 2 wherein said detector means comprises a first transmitter for transmitting a first signal and a first receiver for receiving a second signal, and wherein each of said resonance circuits comprises a second receiver for receiving said first signal and a second transmitter for transmitting said second signal when said second receiver receives said first signal.

5. The system as defined in claim 1 wherein said indicator means comprises a radio frequency transmitter.

6. The system as defined in claim 1 wherein said indicator means comprises a transponder.

7. The system as defined in claim 1 wherein said indicator means comprises a reprogrammable memory module.

8. A system for detecting the passage of an infant from a secure area comprising:

(a) a diaper adapted to be worn by an infant in the secure area;

(b) indicator means embedded in said diaper so that the presence of said indicator means is not sensed by an infant wearing said diaper for causing a signal to be generated indicating passage of said indicator means from the secure area;

(c) detector means positioned adjacent openings to the secure area for detecting passage of said indicator means from the secure area and for generating an electronic signal responsively thereto; and (d) alarm means for providing an alarm signal responsively to receipt of said electronic signal, so that an infant wearing said diaper leaving the secure area is detected electronically by said detector means.

9. The system as defined in claim 8 further comprising conspicuously appearing diapers adapted to be worn by infants outside the secure area, said conspicuously appearing diapers being visually distinguishable from said diaper.

10. A system for detecting the unauthorized passage of an infant wearing an electronically and visually detectable diaper from a secure area, comprising:

(a) a first diaper adapted to be worn by an infant in the secure area, said first diaper comprising, (1) means for presenting a conspicuous appearance so that said first diaper is adapted to be visually distinguished from diapers not having said presenting means, and (2) two water resistant resonance circuits embedded in said first diaper and positioned so that when said first diaper is being worn said two resonance circuits are in nearly perpendicular planes, for causing a signal to be generated indicating passage of said first diaper from the secure area, each of said two resonance circuits comprising a flexible substrate for allowing said two resonance circuits to conform to the shape of said first diaper so that the presence of said circuit in said first diaper is not sensed by an infant wearing said first diaper;

(b) detector means for detecting said resonance circuits and for generating an electronic signal indicative of the presence of said first diaper adjacent said detector means, said detector means being positioned adjacent each passage into and out of the secure area, said detector means comprising a first transmitter for transmitting a first signal and a first receiver for receiving a second signal, and each of said resonance circuits comprising a second receiver for receiving said first signal and a second transmitter for transmitting said second signal when said second receiver receives said first signal; and (c) alarm means for providing an alarm signal in response to receipt of said electronic signal from said detector means, so that an infant wearing said first diaper leaving the secure area causes an alarm signal indicating unauthorized passage of an infant from the secure area, and an infant not wearing said first diaper in the secure area attempting to evade said detector means can be detected visually by lack of said presenting means.

11. A system for detecting the passage of an infant from a secure area, comprising;

(a) an article of apparel to be worn by an infant in the secure area;

(b) a passive resonating circuit hidden within said article of apparel;

(c) transmitting means for generating an electronic signal spanning an egress from the secure area, said electronic signal causing said circuit to resonate when the circuit is passed through said signal;

(d) receiving means for detecting said signal and for detecting resonance in said signal and for detecting resonance in said passive resonating circuit; and, (e) an annunciator means, operatively connected to said receiving means, for indicating the detection of resonance in said passive resonating circuit by said receiving means.

12. The system of claim 11 wherein (a) said electronic signal contains plural frequencies, and (b) said passive resonating circuit consists of a capacitor and an inductor.

13. An electronically detectable diaper for a system for detecting unauthorized removal of an infant from a secure area comprising:

a diaper adapted to be worn by an infant in the secure area; and two resonance circuits embedded in said diaper and positioned so that when said diaper is being worn said two circuits are in nearly perpendicular planes, for causing a signal to be generated indicating passage of said diaper through an opening to the secure area, each of said two circuits comprising a flexible substrate for allowing said circuits to conform to the shape of said diaper so that the presence of said circuits is not sensed by an infant wearing said diaper.

14. The diaper as defined in claim 13 further comprising means for presenting a visually conspicuous appearance so that said diaper is adapted to be visually distinguished from other diapers not having said presenting means.

15. An electronically detectable article of apparel for a system for detecting unauthorized removal of an infant from a secure area comprising:

an article of apparel adapted to be worn by an infant in the secure area; and a resonance circuit carried by said article of apparel for causing a signal to be generated indicating passage of said article of apparel through an opening to the secure area, said circuit comprising a flexible substrate for allowing said circuit to conform to the shape of said article of apparel so that the presence of said circuit is not sensed by an infant wearing said article of apparel.

16. The article of apparel as defined in claim 15 further comprising means for presenting a visually conspicuous appearance so that said article of apparel is adapted to be visually distinguished from other articles of apparel not having said presenting means.

17. A method for detecting the passage of an infant from a secure area comprising the steps of:

(a) providing a first diaper adapted to be worn by an infant in the secure area with a conspicuous appearance so that said first diaper is adapted to be visually distinguished from diapers not having said conspicuous appearance;

(b) embedding indicator means in said first diaper so that the presence of said indicator means is not sensed by an infant wearing said first diaper, said indicator means for causing a signal to be generated indicating passage of said first diaper from the secure area;

(c) positioning detector means adjacent openings to the secure area to thereby detect passage of said first diaper out of the secure area and to generate an electronic signal responsively thereto; and (d) generating an alarm signal responsively to receipt of said electronic signal, so that an infant wearing said first diaper leaving the secure area is detected electronically by said detector means and an infant not wearing said first diaper attempting to evade said detector means can be detected visually by lack of said conspicuous appearance.

18. A method for detecting the passage of an infant from a secure area comprising the steps of:

(a) embedding two resonance circuits having flexible substrates in a diaper adapted to be worn by an infant in the secure area so that the presence of said two circuits is not sensed by an infant wearing said diaper, said two circuits causing a signal to be generated when said diaper passes from the secure area;

(b) positioning said two resonance circuits in said diaper so that when said diaper is being worn said two circuits are in nearly perpendicular planes;

(c) positioning detector means adjacent openings to the secure area to thereby detect passage of said two circuits from the secure area and to generate an electronic signal responsively thereto; and (d) providing an alarm signal responsively to receipt of said electronic signal, so that an infant wearing said diaper leaving the secure area is detected electronically by said detector means.

19. A method for detecting the passage of an infant from a secure area comprising the steps of:

(a) providing a first article of apparel adapted to be worn by an infant in the secure area with a conspicuous appearance so that said first article of apparel is adapted to be visually distinguished from articles of apparel not having said conspicuous appearance;

(b) embedding indicator means in said first article of apparel so that the presence of said indicator means is not sensed by an infant wearing said first article of apparel, said indicator means for causing a signal to be generated indicating passage of said first article of apparel from the secure area;

(c) positioning detector means adjacent openings to the secure area to thereby detect passage of said first article of apparel out of the secure area and to generate an electronic signal responsively thereto; and (d) generating an alarm signal responsively to receipt of said electronic signal, so that an infant wearing said first article of apparel leaving the secure area is detected electronically by said detector means and an infant not wearing said first article of apparel attempting to evade said detector means can be detected visually by lack of said conspicuous appearance.

* * * * *